United States Patent [19]

Scharp

[11] 4,328,502

[45] May 4, 1982

[54] CONTINUOUS SLOT ANTENNAS

[75] Inventor: Glenn A. Scharp, Norco, Calif.

[73] Assignee: The United States of America as represented by the Secretary of the Navy, Washington, D.C.

[21] Appl. No.: 465,807

[22] Filed: Jun. 21, 1965

[51] Int. Cl.[3] ..... H01Q 13/10

[52] U.S. Cl. ..... 343/771

[58] Field of Search ..... 343/767, 771

[56] References Cited

U.S. PATENT DOCUMENTS 3,978,485 8/1976 Bonnaval ..... 343/767

*Primary Examiner*—T. H. Tubbesing

*Attorney, Agent, or Firm*—Robert F. Beers; Joseph M. St. Amand

[57] ABSTRACT

A resonant load is inserted in each end of a continuous curved slot of calculated design in the broad face of a waveguide for improving the electrical characteristics, reducing radiation pattern beamwidth, and extending the useful range of overall slot length. The permittivity and permeability of the load material are controlled to present a matched termination to the field in the slot thereby eliminating standing waves on the slot and improving aperture distribution.

10 Claims, 7 Drawing Figures

CONTINUOUS SLOT ANTENNAS

The invention herein described may be manufactured and used by or for the Government of the United States of America for governmental purposes without the payment of any royalties thereon or therefor.

The present invention relates to antennas and more particularly to continuous-slot traveling wave antennas.

The general purpose of this invention is to improve the radiation patterns of long continuous slot antennas in waveguides. The present antenna, consisting of a continuous curved-slot in the broad face of a rectangular waveguide, has excellent electrical characteristics and is easily designed and constructed. Matched slot terminations for the antenna reduce radiation pattern beamwidths, extend the useful range of overall slot lengths, and permit the use of a wider variety of aperture distributions.

It is an object of the invention, therefore, to provide improved radiation patterns for long continuous slot antennas.

Another object of the invention is to provide an improved continuous curved-slot antenna in the broad face of a rectangular waveguide.

A further object of the invention is to provide improved continuous slot antennas in waveguides for reducing radiation pattern beamwidths, extending useful range overall slot lengths, and permitting use of a variety of aperture distributions.

Other objects and many of the attendant advantages of this invention will become readily appreciated as the same becomes better understood by reference to the following detailed description when considered in connection with the accompanying drawings wherein.

Figure 1:
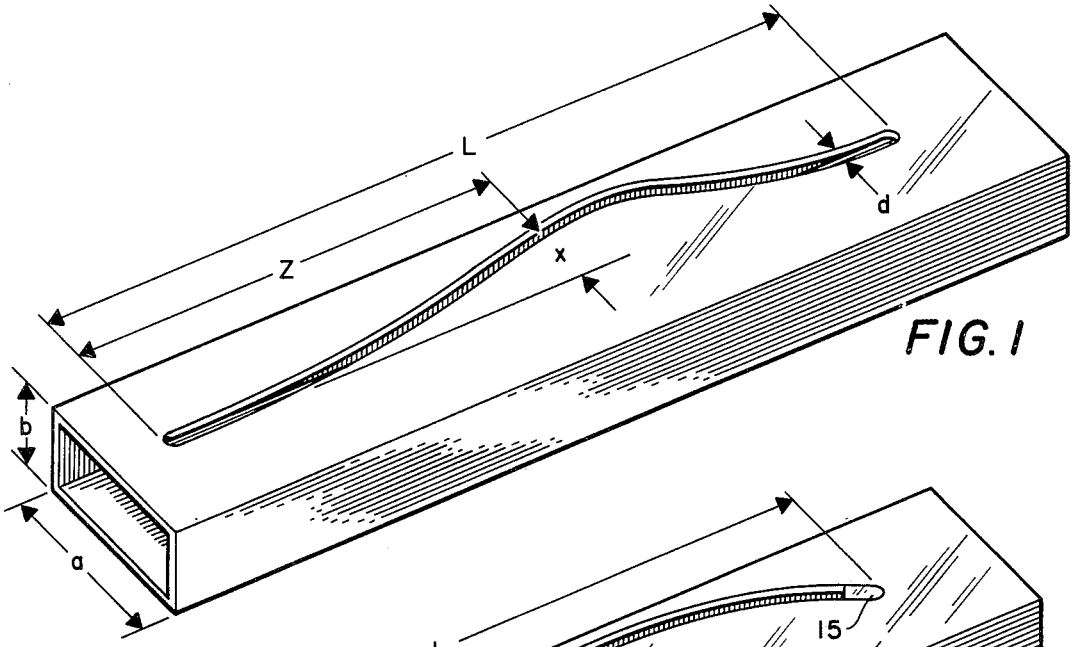
FIG. 1 is a diagram of a continuous long curved-slot antenna is a rectangular waveguide, showing waveguide and slot dimensions.

The continuous curved-slot antenna consists of a single, continuous slot in the broad face of a rectangular waveguide, as shown in FIG. 1, designed to propagate a $TE_{10}$ mode. The waveguide is necessarily terminated in a matched load that absorbs a nominal 5 percent of the total input power to the antenna. The remaining power, assuming waveguide losses are negligible, is made to radiate from the slot according to a predetermined power distribution—or power taper—over the slot length. The power radiated at any point along the slot is determined by the amount of slot offset from the centerline at that point. Almost all conventional aperture power distributions are symmetrical; however, more power is available at the feed end of the antenna. Therefore, with this antenna less slot offset is required for the same radiated power, giving the slot a curved shape.

This continuous curved-slot antenna is a leaky-wave antenna. A unique feature of this antenna is the low side lobe level obtained. Adjustments of the slot widths "d" FIG. 1 and the waveguide internal width "a" were made to obtain a radiation pattern with the look angle of desired design and with the side lobe level less than −30 db relative.

The method of antenna design originates from Equation 1 where, in this case, $P(\xi)=\sin^4\xi$.

$$W_r(1) = \eta = C \int_0^1 P(\xi)d\xi \tag{1}$$

where $W_r(1)$=total power radiated from the entire slot $\eta$=antenna efficiency (fraction)

C=integration constant

P=radiated aperture power distribution as a function of distance along the slot $\xi$=fraction of distance along the slot While integration of some functions $P(\xi)$ are easily accomplished, others are impossible to do classically. Therefore, for sake of generality and ease of solution, all integrations are performed by numerical approximation using $$C = \frac{\eta}{\int_0^1 P(\xi)d} \cong \frac{\eta}{\frac{\Delta}{L}\sum_{i=0}^{L/\Delta} P\left(\frac{i\Delta}{L}\right)} \tag{2}$$

to compute the integration constant C, where $\Delta$ is a small incremental length along the slot. Equation 2 yields a closer approximation as $\Delta$ becomes smaller. It was determined from a digital computer run that $\Delta/L=0.001$ provides good accuracy. Equation 43 from the complete derivation hereinafter described was rewritten for the general case as $$X(i) = \frac{a}{\pi} \arcsin\left\{\frac{1}{K^2}\left[\frac{CP\left(\frac{i\Delta}{L}\right)}{1.0 - C\frac{\Delta}{L}\sum_{j=0}^{i} P\left(\frac{j\Delta}{L}\right)}\right]\right\}^{\frac{1}{2}} \tag{3}$$

where $i=0\rightarrow1000$.

One method for producing the curved-slot antenna is as follows:

Execution of Equations 2 and 3 on an IBM 7094 computer using any suitable power aperture distribution $P(\xi)$, produces 1001 punched cards describing the slot shape for a single antenna design. These cards can then be processed by an Automatic Programmed Tool (APT) System on an IBM 7094, and the results placed on IBM cards. The IBM cards can be converted to a punched paper tape using a Univac digital computer. The punched paper tape placed on a Bendix tape drive of a Pratt & Whitney programmed end mill with the waveguide in position can produce a continuous curved-slot antenna in a few minutes. Although such procedure is rather involved initially, it is accurate, smooth, and repeatable.

This process can be easily automated using other combinations of digital computers and numerically controlled end mills for which suitable programming software is available.

Figure 2:
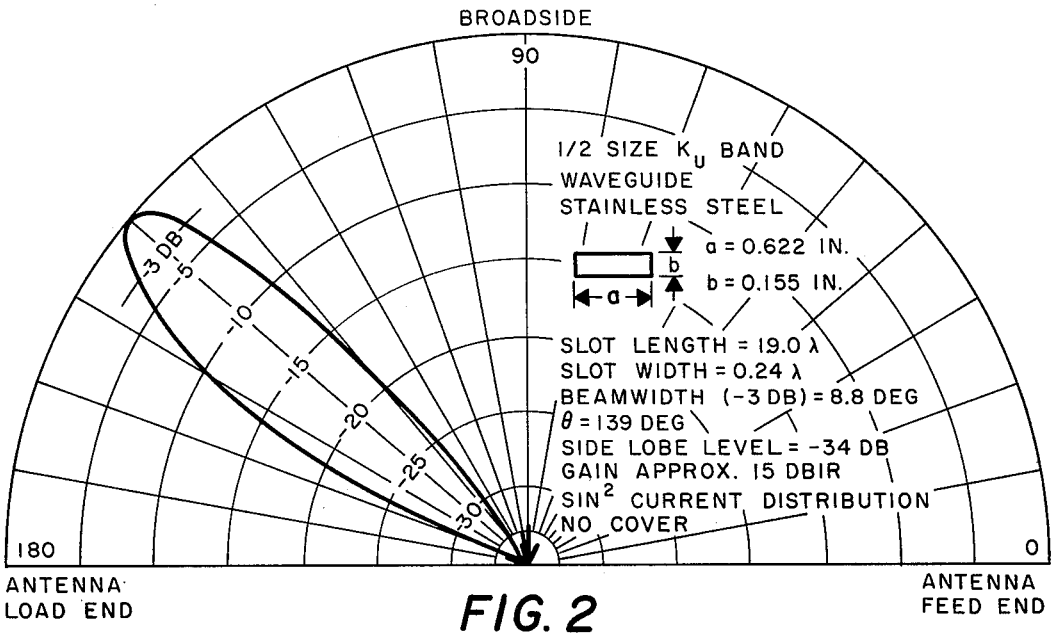
FIG. 2 shows a measured antenna pattern for $\sin^2$ current distribution.

The resultant radiation pattern of the $\sin^2$ design antenna are shown in FIG. 2. Side lobes are less than −30 db. Certain other desirable electrical and mechanical characteristics of these antennas were found. Leakage measurements between two antennas mounted on a cylinder 13 in. in diameter showed a reduction in coupling of 25 db relative to conventional discrete-slot arrays. The antennas are relatively insensitive to covers of teflon-impregnated fiberglas up to 1/32 in. thick.

Current distributions other than $\sin^2$ have also been programmed, designed, and constructed. The status and results are listed in the Table below. The $\sin^{3/2}$ and $\sin^{\frac{1}{2}}$ distributions gave fair results. The $\sin^2$ distribution was significantly better than that of the sine.

Table for Various Current Distributions

| Amplitude Distribution | Theoretical Side Lobe Level (db) | Measured Side Lobe Level (db) | Measured −3 db Beam Width (deq) | Measured Input (VSWR) | Antenna Length (wave-lengths) |
|---|---|---|---|---|---|
| $\sin^2$ | −32 | −34 | 8.8 | 1.13 | 19.0 |
| $\sin^{3/2}$ | UD | −21 | 13.0 | NM | 9.1 |
| Sin | −23 | −27 | 10.5 | 1.08 | 9.1 |
| $\sqrt{\sin}$ | UD | −17.5 | 9.0 | NM | 9.1 |
| *T. T. Taylor | −40 | −32 | 6.0 | NM | 19.0 |
| **Van der Maas Approximation to Dolph | −40 | −25 | 12.0 | NM | 9.1 |
| ***Dolph Fitted Polynomial | UD | NM | NM | NM | 9.1 |

NM - Quantity not measured.
UD - Undetermined.
*T. T. Taylor, Design of Line Sources for Narrow Beamwidth and Low Side Lobes, TM No. 316, Hughes Aircraft Company, Culver City, California, 1953.
**G. J. Van der Maas, A Simplified Calculation for Dolph-Tschebyscheff Arrays, J. Appl. Phys., Vol. 25, pp 121-124, January 1954.
***Similar to the $\sin^4$ power distribution below where the $\sin^4$ function is replaced by a polynomial[4] fitted to a Dolph distribution.

The continuous curved-slot antenna is a significant improvement over conventional prior antenna.

A complete derivation of the continuous curved-slot antenna for $\sin^2$ distribution is as follows:

FIG. 1 is a sketch of the continuous curved-slot antenna showing the coordinate system and dimensional notation.

Let Z be the distance along a continuous slot of total length L, where the feed end is at Z=0.0. Assume that this slot has an aperture power distribution P(Z/L) of $\sin^4$. Define a normalization constant C relating a selected aperture power distribution to the square of the field across the slot at any point Z by $$P(Z/L)=CE^2(Z/L) \tag{4}$$

Define $W_r(l)$ to be the total power that has been radiated after reaching the end of the slot (where Z=L or Z/L=1.0). Then define $W_p(l)$ as the power remaining in the waveguide at the end of the slot. This power ($W_p(l)$ 0.0) dissipates in the waveguide load and $$W_r(l)=1.0-W_p(l) \tag{5}$$

where $$W_r(1) = \int_0^1 P\left(\frac{Z}{L}\right) d\left(\frac{Z}{L}\right) = C \int_0^1 E^2\left(\frac{Z}{L}\right) d\left(\frac{Z}{L}\right) \tag{6}$$

which states that the total power radiated is the summation of all the power radiated along the slot.

Selecting any point Z≠L (somewhere along the slot), Equation 6 becomes $$W_r\left(\frac{Z}{L}\right) = 1.0 - W_p\left(\frac{Z}{L}\right) = \int_0^{Z/L} P(\xi)d\xi = C \int_0^{Z/L} E^2(\xi)d\xi \tag{7}$$

where $\xi$ is a dimensionless variable representing a fraction of slot length.

Rearrangement of Equation 7 gives $$W_p\left(\frac{Z}{L}\right) = 1.0 - W_r\left(\frac{Z}{L}\right) = 1.0 - \int_0^{Z/L} P(\xi)d\xi \tag{8}$$

which is the power remaining in the waveguide at any point O≦Z≦L.

Define a coupling coefficient, A(Z/L), to be the fraction of the power in the waveguide at Z that is to be radiated; that is $$A\left(\frac{Z}{L}\right) = \frac{P\left(\frac{Z}{L}\right)}{W_p\left(\frac{Z}{L}\right)} \tag{9}$$

or $$A\left(\frac{Z}{L}\right) = \frac{P\left(\frac{Z}{L}\right)}{1.0 - \int_0^{Z/L} P(\xi)d\xi} \tag{10}$$

or $$1.0 - \int_0^{Z/L} P(\xi)d\xi = \frac{P\left(\frac{Z}{L}\right)}{A\left(\frac{Z}{L}\right)} \tag{11}$$

Since both $\xi$ and Z/L represent a fraction of slot length, both sides of the preceding equation can be differentiated with respect to Z/L to obtain the equation $$-P\left(\frac{Z}{L}\right) = \frac{A\left(\frac{Z}{L}\right) P'\left(\frac{Z}{L}\right) - P\left(\frac{Z}{L}\right) A\left(\frac{Z}{L}\right)}{A^2\left(\frac{Z}{L}\right)} \tag{12}$$

This is a linear first-order differential equation of the form $$P' + \left(A - \frac{A'}{A}\right) P = 0 \tag{13}$$

which has as its solution $$P\left(\frac{Z}{L}\right) = \exp\left[-\int_0^{Z/L}\left(A - \frac{A'}{A}\right) d\xi\right] \tag{14}$$

or $$P\left(\frac{Z}{L}\right) = A\left(\frac{Z}{L}\right) \exp\left[-\int_0^{Z/L} A(\xi)d\xi\right] \tag{15}$$

Substituting Equation 15 into Equation 7 gives $$W_r\left(\frac{Z}{L}\right) = {}_0^{Z/L} A(\xi)\exp\left[-{}_0^{Z/L} A(\xi)d\xi\right] d\xi = \tag{16}$$

$$-{}_0^{Z/L} \exp\left[-\int_0^{Z/L} A(\xi)d\xi\right] [-A(\xi)]d\xi$$

Letting $$u = -\int_0^{Z/L} A(\xi)d\xi \tag{17}$$

and $$du = -A(\xi)d\xi \tag{18}$$

gives $$W_r\left(\frac{Z}{L}\right) = -\int e^u\, du = -e^u + c = \tag{19}$$

$$-\exp\left[-\int_0^{Z/L} A(\xi)d\xi\right] + c$$

where c is a constant of integration.

At $$Z=0.0,\ W_r(Z/L)=0.0$$

and

-continued $$-\exp\left[-\int_0^{Z/L} A(\xi)d\xi\right] = -e^{-0.0} = -1.0 \tag{20}$$

Therefore $$c = +1.0 \tag{21}$$

$$W_r\left(\frac{Z}{L}\right) = 1.0 - \exp\left[-\int_0^{Z/L} A(\xi)d\xi\right] \tag{22}$$

and $$W_p\left(\frac{Z}{L}\right) = \exp\left[-\int_0^{Z/L} A(\xi)d\xi\right] \tag{23}$$

Assume that resistive losses are negligible and radiation losses are related to an attenuation function 2a(Z) nepers/unit of length. Attenuation in nepers/inch is defined as the power loss/inch divided by the total power in the waveguide, or $$2a(Z) = \left[\frac{-1}{W_p(Z)}\right]\left[\frac{dW_p(Z)}{dZ}\right] \tag{24}$$

Since $$\frac{dW_p(Z)}{dZ} = \left(\frac{1}{L}\right)\left[\frac{dW_p\left(\frac{Z}{L}\right)}{d\left(\frac{Z}{L}\right)}\right] \tag{25}$$

$$2a\left(\frac{Z}{L}\right) = \left[\frac{-1}{W_p\left(\frac{Z}{L}\right)}\right]\left[\frac{dW_p\left(\frac{Z}{L}\right)}{Ld\left(\frac{Z}{L}\right)}\right] \tag{26}$$

Differentiating both sides of Equation 8 with respect to (Z/L) and substituting Equation 9 gives $$\frac{dW_p\left(\frac{Z}{L}\right)}{d\left(\frac{Z}{L}\right)} = -P\left(\frac{Z}{L}\right) = -A\left(\frac{Z}{L}\right) W_p\left(\frac{Z}{L}\right) \tag{27}$$

Substituting Equation 27 into Equation 26 gives $$2a(Z/L)L = A(Z/L) \tag{28}$$

The Z component of the magnetic field in a rectangular waveguide propagating a $TE_{10}$ mode is $$H_z\left(\frac{Z}{L}, X\right) = j\sqrt{\frac{\epsilon}{\mu}}\ \frac{\lambda}{\lambda_c} E_o\left(\frac{Z}{L}, 0\right) \sin\frac{\pi}{a} X\left(\frac{Z}{L}\right) \tag{29}$$

where $\epsilon$=permittivity of the waveguide filler $\mu$=permeability of the waveguide filler $\lambda$=free space wavelength $\lambda_c$=waveguide cutoff wavelength $E_o(Z/L)$=electric field (along the Y axis) at X=0.0 as a function of Z/L X(Z/L)=distance from the centerline of the waveguide broadface a=inside broad dimension of the waveguide cross-section The standard E to H relationship gives $$E_o\left(\frac{Z}{L}, X\right) = \sqrt{\frac{\mu}{\epsilon}}\, H_o\left(\frac{Z}{L}, X\right) = j\frac{\lambda}{\lambda_c} E_o\left(\frac{Z}{L}, 0\right) \sin\frac{\pi}{a} X\left(\frac{Z}{L}\right) \tag{30}$$

Applying the Power Theorem (J. D. Kraus, *Antennas*, Electrical and Electronic Engineering Series; New York: McGraw-Hill, 1950, pp. 13–15.) to the slot aperture gives $$dW_r\left(\frac{Z}{L}\right) = P\left(\frac{Z}{L}\right) = \tfrac{1}{2}\iint \overline{E}_o\left(\frac{Z}{L}, X\right)\overline{H}_o{}^*\left(\frac{Z}{L}, X\right) d\overline{S} = \tfrac{1}{2}\sqrt{\frac{\epsilon}{\mu}}\left(\frac{\lambda}{\lambda_c}\right)^2 dE_o{}^2\left(\frac{Z}{L}, 0\right)\sin^2\frac{\pi}{a} X\left(\frac{Z}{L}\right) dZ \tag{31}$$

where $\overline{dS}=\overline{j}_y d\, dZ$, d=slot width, * implies complex conjugate, and the $\frac{1}{2}$ is required to obtain the average power from the square of the peak electric field $E_o$. Because the energy is radiated into half-space, another $\frac{1}{2}$ must be introduced, giving $$dW_r\left(\frac{Z}{L}\right) = \tfrac{1}{4}\sqrt{\frac{\epsilon}{\mu}}\left(\frac{\lambda}{\lambda_c}\right)^2 d\, E_o{}^2\left(\frac{Z}{L}, 0\right) \sin^2\frac{\pi}{a} X\left(\frac{Z}{L}\right) dZ \tag{32}$$

The power (G. C. Southworth, *Principles and Application of Waveguide Transmissions*. New York: D. Van Nostrand, 1950, p. 104.) in the waveguide at Z/L is given by $$W_p\left(\frac{Z}{L}\right) = \sqrt{\frac{\epsilon}{\mu}}\,\frac{\lambda}{\lambda_g}\,\frac{ab}{4}\, E_o{}^2\left(\frac{Z}{L}, 0\right) \tag{33}$$

Dividing Equation 32 by Equation 33 gives $$\frac{dW_r\left(\frac{Z}{L}\right)}{dZ\, W_p\left(\frac{Z}{L}\right)} = \left[\frac{(\lambda/\lambda_c)^2}{(\lambda/\lambda_g)^a}\right]\frac{d}{b}\sin^2\frac{\pi}{a} X\left(\frac{Z}{L}\right) = \left(\frac{2\lambda\lambda_q}{\lambda_c{}^3}\right)\frac{d}{b}\sin^2\frac{\pi}{a} X\left(\frac{Z}{L}\right) \tag{34}$$

after substituting, $$\lambda_c = 2a \tag{35}$$

$$d(Z) = Ld(Z/L) \tag{36}$$

and $$dW_r(Z) = dW_r(Z/L) \tag{37}$$

The change in the power radiated from the slot at any point Z/L is equal to the negative of the change in the power remaining in the waveguide, or $$dW_r(Z/L) = -dW_p(Z/L) \tag{38}$$

The derivation from Equations 24, 34, 36, 37, and 38 is $$\frac{dW_r\left(\frac{Z}{L}\right)}{dZ}\,\frac{1}{W_P\left(\frac{Z}{L}\right)} = \frac{-dW_p\left(\frac{Z}{L}\right)}{d\left(\frac{Z}{L}\right)}\,\frac{1}{LW_p\left(\frac{Z}{L}\right)} = 2a\left(\frac{Z}{L}\right) \tag{39}$$

And, from Equations 28, 34, and 39, $$2a\left(\frac{Z}{L}\right) L = A\left(\frac{Z}{L}\right) = \frac{2d\lambda\lambda_g L}{b\lambda_c{}^3}\sin^2\frac{\pi}{a} X\left(\frac{Z}{L}\right) \tag{40}$$

Make $$W_r(1) = \int_0^1 P(\xi)d\xi = \eta < 1.0 \tag{41}$$

For example, $\eta$=0.95, where 0.95 is the efficiency.

Equating Equations 10 and 40 gives $$\frac{2d\lambda\lambda_g L}{b\lambda_c{}^3}\sin^2\frac{\pi}{a} X\left(\frac{Z}{L}\right) = \frac{P\left(\frac{Z}{L}\right)}{1.0 - \int_0^{Z/L} P(\xi)d\xi} \tag{42}$$

Solving Equation 42 for X(Z/L) gives $$X\left(\frac{Z}{L}\right) = \frac{a}{\pi}\arcsin\sqrt{\left[\frac{1}{\frac{2d\lambda\lambda_g L}{b\lambda_c{}^3}}\right]\left[\frac{P\left(\frac{Z}{L}\right)}{1.0 - \int_0^{Z/L} P(\xi)d\xi}\right]} \tag{43}$$

Define $$K^2 = \frac{2d\lambda\lambda_g L}{b\lambda_c{}^3} \tag{44}$$

It has been found empirically from practical experience that a good value for $K^2$ in an X-band waveguide is 13.0±25 percent. The slot width (d) can be calculated from Equation 44 when the frequency, waveguide, and slot length L have been selected by the antenna designer. Also, experience has shown that 0.95 is a practical efficiency and that the maximum practical slot offset from the waveguide centerline is 0.3a. The look angle $\theta$ measured from the load end is determined from $$\theta = \arcsin(\lambda/\lambda'_c) \tag{45}$$

where $$\lambda'_c = \sigma\lambda_c \tag{46}$$

$\sigma$ = an empirical constant in the range $$0.93 < \sigma < 0.98 \tag{47}$$

If the $\sin^4$ power aperture distribution is substituted, then $$W_r\left(\frac{Z}{L}\right) = C\int_0^{Z/L} P(\xi)d\xi\; C\int_0^{Z/L} \sin^4 U\, dU \tag{48}$$

Letting $U = \pi\xi$ (49)

$$dU = \pi d\xi \tag{50}$$

and $$C\int_0^{Z/L} \sin^4 U\, dU = \frac{C}{\pi}\int_0^{Z/L} \sin^2(\pi\xi)\,\pi d\xi$$

$$= \frac{C}{\pi}\left[\frac{-\sin^3 \pi\frac{Z}{L}\cos\pi\frac{Z}{L}}{4} + \frac{3}{4}\int_0^{Z/L}\sin^2\left(\pi\frac{Z}{L}\right)\pi d\left(\frac{Z}{L}\right)\right] \tag{51}$$

$$= \frac{C}{\pi}\left[\frac{-\sin^3 \pi\frac{Z}{L}\cos\pi\frac{Z}{L}}{4} + \frac{3}{4}\left(-\tfrac{1}{2}\cos\pi\frac{Z}{L}\sin\pi\frac{Z}{L} + \tfrac{1}{2}\pi\frac{Z}{L}\right)\right]$$

$$= C\left(\frac{3}{8}\frac{Z}{L} - \frac{3}{8\pi}\cos\pi\frac{Z}{L}\sin\pi\frac{Z}{L} - \frac{1}{4\pi}\sin^3\pi\frac{Z}{L}\cos\pi\frac{Z}{L}\right) \tag{51}$$

However, at Z=L (or Z/L=1.0), $W_r(1)=0.95=\eta$ efficiency, so that $$C = (8/3)\eta \tag{52}$$

$$\int_0^{Z/L} P(\xi)d\xi = \eta\left(\frac{Z}{L} - \frac{1}{\pi}\cos\pi\frac{Z}{L}\sin\pi\frac{Z}{L} - \frac{2}{3\pi}\sin^3\pi\frac{Z}{L}\cos\pi\frac{Z}{L}\right) \tag{53}$$

and

-continued $$P\left(\frac{Z}{L}\right) = C\,E^2\left(\frac{Z}{L}\right) = \frac{8\eta}{3}E^2\left(\frac{Z}{L}\right) = \frac{8\eta}{3}\sin^4\pi\frac{Z}{L} \tag{54}$$

Substituting Equations 44, 53, and 54 into Equation 42 gives, for $\eta=0.95$, $$K^2\sin^2\frac{\pi}{a}X\left(\frac{Z}{L}\right) = \frac{\frac{8\eta}{3}\sin^4\pi\frac{Z}{L}}{1.0-\eta\left(\frac{Z}{L}-\frac{1}{\pi}\sin\pi\frac{Z}{L}\cos\pi\frac{Z}{L}-\frac{2}{3\pi}\sin^3\pi\frac{Z}{L}\cos\pi\frac{Z}{L}\right)} \tag{55}$$

$$= \frac{2.533\sin^4\pi\frac{Z}{L}}{1.0-0.95\left(\frac{Z}{L}+0.302\sin\pi\frac{Z}{L}\cos\pi\frac{Z}{L}+0.202\sin^3\pi\frac{Z}{L}\cos\pi\frac{Z}{L}\right)}$$

It has been found experimentally that the practical range of slot length is $10\lambda < L < 30\lambda$.

Equation 55 has been solved for X(Z/L); that is, the slot offset from the waveguide centerline as a function of distance Z along the slot for a $\sin^4$ power distribution. Any other power distribution $P(\xi)$ requires another integration.

RESONANT LOADING OF SLOT ENDS

The continuous slot antenna consists of a long slot in the broad face of a rectangular waveguide propagating a $TE_{10}$ mode. A continuous curved-slot has been thoroughly described above; a typical continuous straight slot, which also can be loaded as described herein, is disclosed in copending patent application Ser. No. 225,941, filed Sept. 24, 1962, now U.S. Pat. No. 3,208,068.

As shown in FIG. 1 of the drawings, the continuous slot 12 is positioned on one side of the waveguide centerline and slot coupling is controlled by varying the offset distance, X, from the centerline to a predetermined aperture distribution. The waveguide 10 when terminated at the load end in a matched load absorbing 5% of the total input power into the antenna will have a radiation pattern having a low relative side lobe level (less than −30 db, for example) with respect to the main beam. However, the aperture distribution is not optimized due to slot end effects.

Figure 3:
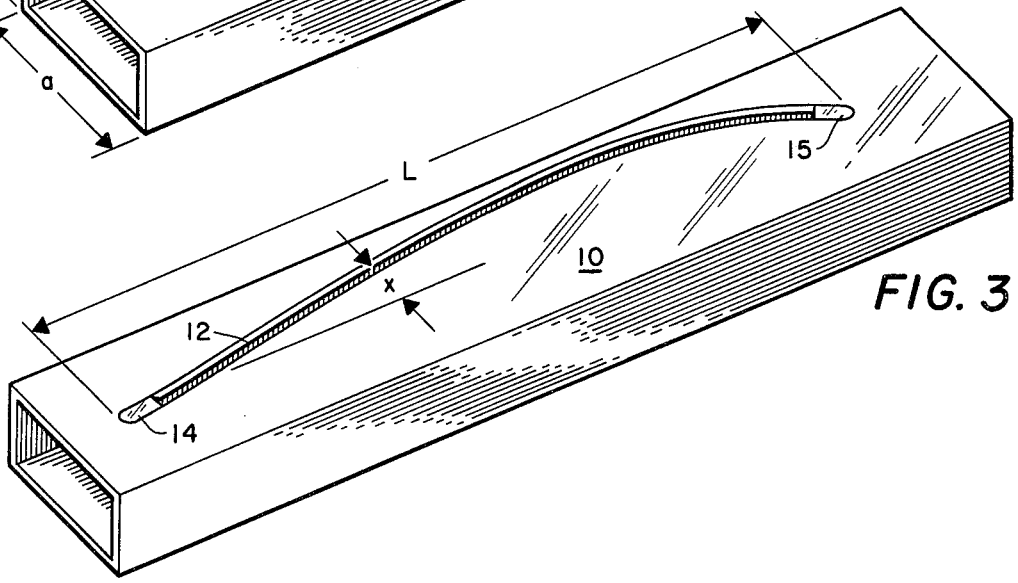
FIG. 3 shows the continuous curved-slot antenna having the ends of the slot terminated with matched resonant loads.
Figure 4:
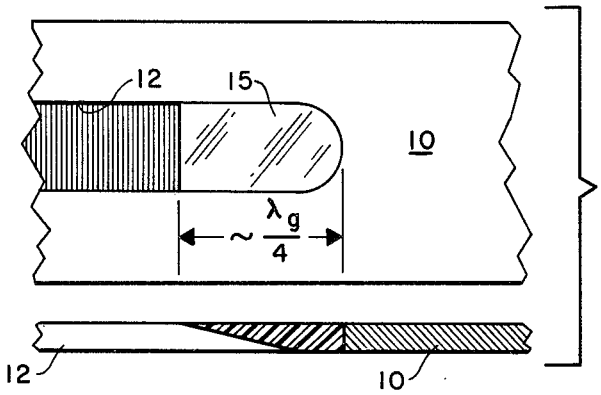
FIG. 4 is a cross-section of a loaded slot end showing a tapered thickness.

To improve the radiation pattern of long continuous slot antennas in waveguide a resonant load, of lossy dielectric or ferrite material for example, is inserted in each end 14 and 15 of the slot 12, as shown in FIG. 3. The load material can be tapered as shown in FIG. 4 and the permittivity and permeability controlled to present a matched termination to the field in the slot. This will eliminate standing waves on the slot and improve the aperture distribution.

Figure 5:
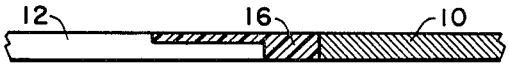
FIG. 5 shows a stepped thickness loaded slot end.
Figure 6:
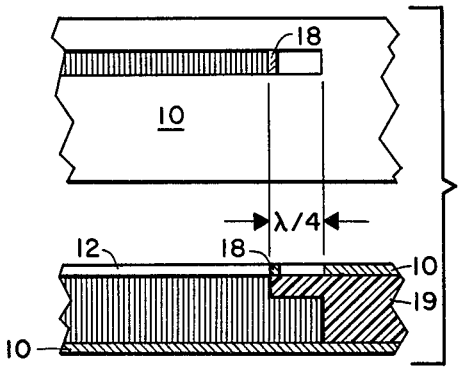
FIG. 6 shows a partially loaded slot end with a stepped resonant load inside the waveguide.

The load material 16 can also be stepped as shown in FIG. 5, the step being a quarter wavelength, λ/4, long; or the slot can be loaded with a thin slab 18 of lossy material λ/4 from the slot end as shown in FIG. 6 together with a stepped resonant load 19 inside the waveguide 10.

Figure 7:
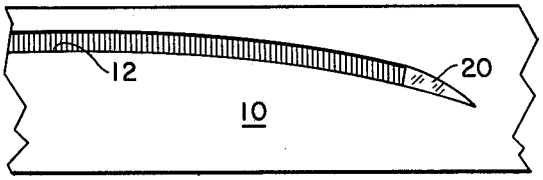
FIG. 7 shows gradually tapered slot end filled with a resonant load.

Another means of slot end termination consists of gradually tapering the filled slot ends to zero width, as shown at 20 in FIG. 7, to reduce reflections.

Obviously many modifications and variations of the present invention are possible in the light of the above teachings. It is therefore understood that within the scope of the appended claims the invention may be practiced otherwise than as specifically described.

I claim:

1. A continuous slot antenna having improved radiation pattern comprising:

(a) a section of rectangular waveguide, (b) a long continuous slot cut in one broad face of said waveguide, (c) said slot being positioned on one side of the waveguide centerline and the slot coupling being controlled by varying the distance said slot is offset from said centerline along the length thereof to conform to a predetermined aperture distribution, the power radiated at any point along the slot being determined by the amount of slot offset from the centerline at that point, (d) a resonant load inserted in each of the ends of said slot, whereby standing waves on the slot are eliminated and aperture distribution is improved.

2. An antenna as in claim 1 wherein said resonant load is tapered in thickness.

3. An antenna as in claim 1 wherein the resonant load is stepped.

4. An antenna as in claim 1 wherein the slot ends are gradually tapered to zero width.

5. An antenna as in claim 1 wherein said resonant loads are thin lossy slabs positioned across said slot at approximately one-quarter wavelength from the ends thereof, and a stepped load is positioned inside the waveguide at the load end thereof beneath said thin lossy slab.

6. A continuous slot antenna having improved radiation pattern comprising:

(a) a section of rectangular waveguide for propagating a $TE_{10}$ mode, (b) a long continuous curved-slot in one broadface of said waveguide, (c) said slot being positioned to one side of the waveguide centerline, (d) the general design equation of said slot applicable to any continuous current distribution being $$X(i) = \frac{a}{\pi} \arcsin\left\{ \frac{1}{K^2} \left[ \frac{CP\left(\frac{i\Delta}{L}\right)}{1.0 - C\frac{\Delta}{L}\sum_{j=0}^{i} P\left(\frac{j\Delta}{L}\right)} \right] \right\}^{\frac{1}{2}}$$

where

X = the amount of slot offset from said waveguide centerline at any point i along the slot, i = 0→1000, a = width of broadface of waveguide (internal)

$$K^2 = \frac{2d\lambda\lambda_g L}{b\lambda_c^3}$$

b = width of narrow face of waveguide (internal)

d = width of slot

L = length of waveguide between ends of slot,

λ = wavelength in free space $$\lambda_g = \text{wavelength in waveguide} = \frac{\lambda}{\sqrt{1 - \left(\frac{\lambda}{\lambda_c}\right)^2}},$$

when $\lambda_c = 2a$ and both the permeability and the permittivity of any dielectric filler in the waveguide each = 1, where $$C = \frac{\eta}{\int_0^1 P(\xi)d\xi} \cong \frac{\eta}{\frac{\Delta}{L}\sum_{i=0}^{L/\Delta} P\left(\frac{i\Delta}{L}\right)}$$

η = antenna efficiency (fraction),

P = radiated aperture power distribution as a function of distance along the slot, ξ = fraction of distance along the slot, Δ/L = incremental distance along waveguide normalized to slot length, (e) a resonant load inserted in each of the ends of said slot, whereby standing waves on the slot are eliminated and aperture distribution is improved.

7. An antenna as in claim 6 wherein said resonant load is tapered in thickness.

8. An antenna as in claim 6 wherein the resonant load is stepped.

9. An antenna as in claim 6 wherein the slot ends are gradually tapered to zero width.

10. An antenna as in claim 6 wherein said resonant loads are thin lossy slabs positioned across said slot at approximately one-quarter wavelength from the ends thereof, and a stepped load is positioned inside the waveguide at the load end thereof beneath said thin lossy slab.

* * * * *